US008561623B2

(12) United States Patent
Lowenstein

(10) Patent No.: US 8,561,623 B2
(45) Date of Patent: Oct. 22, 2013

(54) APPARATUS FOR REMOVING DEBRIS FROM GUTTERS, TROUGHS AND OTHER OVERHEAD OPEN CONDUITS

(76) Inventor: Arnold Lowenstein, Hayward, CA (US)

( * ) Notice: Subject to any disclaimer, the term of this patent is extended or adjusted under 35 U.S.C. 154(b) by 375 days.

(21) Appl. No.: 12/653,168

(22) Filed: Dec. 8, 2009

(65) Prior Publication Data

US 2011/0132405 A1 Jun. 9, 2011

(51) Int. Cl.
*B08B 3/04* (2006.01)
*B08B 3/00* (2006.01)

(52) U.S. Cl.
USPC ..... 134/104.2; 134/167 R

(58) Field of Classification Search
USPC ..... 134/104.2, 167 R
See application file for complete search history.

(56) References Cited

U.S. PATENT DOCUMENTS

| | | | | |
|---|---|---|---|---|
| 1,661,480 | A * | 3/1928 | Keefer | 15/321 |
| 3,023,971 | A * | 3/1962 | Milhous | 401/137 |
| 3,908,910 | A * | 9/1975 | Detwiler | 239/280 |
| 5,056,187 | A | 10/1991 | Higgins | 15/339 |
| 5,195,209 | A | 3/1993 | Watkins | 15/339 |
| 5,555,597 | A * | 9/1996 | Berfield | 15/321 |
| 5,727,580 | A * | 3/1998 | Patterson | 134/115 R |
| 5,855,402 | A * | 1/1999 | Maraschiello | 294/104 |
| 6,185,782 | B1 | 2/2001 | Hall | 15/339 |
| 2001/0042284 | A1 | 11/2001 | Gutry | 15/414 |
| 2004/0020516 | A1* | 2/2004 | Buckner | 134/21 |
| 2005/0221739 | A1* | 10/2005 | Hoffmann et al. | 451/357 |
| 2006/0117671 | A1* | 6/2006 | Seasholtz et al. | 52/11 |
| 2006/0289036 | A1* | 12/2006 | Hilton | 134/22.11 |

FOREIGN PATENT DOCUMENTS

| | | | |
|---|---|---|---|
| DE | 2170877 | A | 8/1986 |

* cited by examiner

*Primary Examiner* — Joseph L Perrin
*Assistant Examiner* — Charles W Kling
(74) *Attorney, Agent, or Firm* — Shirley L. Church, Esq.

(57) ABSTRACT

The apparatus removes debris from overhead open conduits. The apparatus includes a shaped conduit with closed sidewalls. The top portion of the shaped conduit exhibits a bend which permits it to reach into the open conduit. The portion of conduit beneath the bend is straight. On the straight portion there is an on-off switch which sends a wireless signal to a switch on a source of vacuum which is attached to the straight portion. Adjacent the on-off switch there may be a valve which controls an amount of water applied from a water line attached to the shaped conduit.

10 Claims, 8 Drawing Sheets

APPARATUS FOR REMOVING DEBRIS FROM GUTTERS, TROUGHS AND OTHER OVERHEAD OPEN CONDUITS

FIELD OF THE INVENTION

Embodiments of the present invention relate to an apparatus useful in removing debris such as pine needles, leaves and sludge from gutters, troughs and other overhead open conduits for water flow.

BACKGROUND OF THE INVENTION

This section describes background subject matter related to the disclosed embodiments of the present invention. There is no intention, either express or implied, that the background art discussed in this section legally constitutes prior art.

Gutter cleaning devices have been available prior to the present apparatus. A number of devices have attempted to provide a means of removing leaves and other debris which form a semi-solid sludge within a gutter. However, the previous devices have been problematic, particularly when the debris to be removed includes pine needles or twigs in combination with the leaves and dirt which gradually accumulate, particularly in the fall of the year. Many of the previous devices include motors or other features which make the device heavy and difficult to carry.

Examples of previous devices used for gutter cleaning include those described in the representative references which follow. U.K. Patent Application GB 2170877A of Stanley Williams, published on Aug. 13, 1986, discloses a device which can be fitted onto the end of a hollow handle which is connected to a wet and dry vacuum cleaner. The device is designed to cut waste such as soil or leaves which are present in guttering or drains. (Abstract). The device includes a circular tube with a cutting edge to cut through waste which could block the tube leading to another tube which feeds the vacuum cleaner. (Specification and Claims) The sole FIGURE shows a cutting shape present in the leading face of a tubular-shaped device. Material to be pulled into the tube leading to the vacuum cleaner must pass through the leading face containing the non-moving cutting shape. This reduces the strength of the vacuum available to move the debris along its way to the collection area of the vacuum cleaner.

U.S. Pat. No. 5,056,187 to Wayne Higgins, issued Oct. 15, 1991 describes an attachment for a vacuum system used to clean eave troughs of a building from ground level. The attachment includes an arcuately-shaped, semi-rigid tubular member which connects to an elongated tube of a vacuum system. The curvature and dimensions of the arcuate attachment are said to allow the operator of the vacuum system to raise the attachment up to the eve trough and insert the free end of the attachment into the trough. A mirror is mounted on the intrados surface of the arcuate attachment, to permit the operator standing on the ground to view the inner bottom surface of the trough which is being cleaned. The free end of the attachment tapers to a smaller diameter to facilitate mounting of other attachments thereto. The free end of the attachment is said to have a plurality of axial slits which prevent clogging of the attachment. (Abstract). The axial slits are also said to prevent the end portion from becoming stuck to the bottom of the trough. Various secondary attachments are said to be applied to the free, open end of the arcuately-shaped tubular attachment. The only secondary attachment illustrated is one which narrows to a flat section, similar to a vacuum cleaner attachment designed to reach into narrow openings.

U.S. Pat. No. 5,195,209 to Watkins, issued Mar. 23, 1993, describes a gutter cleaning system which includes a canister type vacuum cleaner with tubular wand sections and a nozzle adapted to be inserted into a gutter. The nozzle carries an optical viewing system such as a fiber optic device of a television camera enabling the operator to observe the cleaning operation as it is performed. The canister type vacuum cleaner is illustrated as one which can be carried over the back of the operator of the system. In addition to the canister, the system includes a bag. During operation, wet debris is said to fall into the canister where it is collected. Dry dirt, leaves and the like are said to pass through an impeller (located at the top of the canister) and to pass through to the collecting bag. The canister is shown to have a motorized impeller, and the complete system appears to be bulky and problematic to manipulate.

U.S. Pat. No. 6,185,782 to Hall, issued Feb. 13, 2001 pertains to a rain gutter cleaning system which has an agitator head that is mounted at the top end of a long suction head and pole, where the agitator head is supported by the suction head and pole. A vacuum pump on the ground is connected to bring the rain gutter debris down the suction tube and into a collection bag. The agitator head includes rotating paddles to tear and break up tangles and clogs encountered in a rain gutter, and has a rotating auger screw inside that helps direct the loosened debris down the throat of the suction tube. A camera mounted atop the agitator head allows an operator on the ground below to see the inside of the rain gutter on a small monitor screen. (Abstract) The system may include a back pack power unit. The opening of the adaptor tube is said to be fitted with a paddle wheel or rotating string device, similar in appearance to a weed-eater, but smaller, which is used to break up any matter leaves or other debris. This is said to make the vacuuming go quicker and to aid in preventing clogging of a material in the vacuum tube. This unit also appears to be very bulky, heavy and complex to operate.

U.S. Published Patent Application No. US 2001/0042284 A1 of Judy Gutry, published Nov. 22, 2001, describes a gutter cleaner having a head and a handle. The head is tubular and has a bend and a nozzle. The bend curves in two perpendicular directions, through one angle of 135° to 195° and another angle of 15° to 60°. The nozzle has an egress with one dimension being narrower than the other. The head and the handle slidably fit together and are secured to fix their relative positions. The lower end of the handle is adapted to attach to a vacuum source. The handle has a textured surface for gripping and eyelets for removably detaching a shoulder strap. Optionally the handle has two sections that are slidably fitted together and that can be secured relative to each other. (Abstract)

U.S. Published Patent Application No. U.S. 2004/0020516 of Don Martin Buckner, published Feb. 5, 2004 discloses a method of removing debris from a roof gutter, which includes the steps of providing a vacuum conduit having a first end located in proximity to the debris in the gutter and a second end connected to a vacuum tank which has a vacuum producing means. The first end of the vacuum conduit has a water and/or air dispensing means to dislodge or make vacuum able the debris located within the gutter. Mechanical means may be utilized in proximity of the first end of the vacuum conduit to break up debris. A monitoring means may be utilized in proximity to the first end of the vacuum conduit to monitor vacuuming progress and/or control the vacuum and or debris dislodging means.

The various apparatus described above are exemplary of the kinds of apparatus which are known in the art. The apparatuses vary in complexity; however, all of the apparatuses include a source of vacuum, a rigid conduit which makes direct contact with the gutter, and a flexible hose from the conduit to the vacuum source. Several of the references describe the use of a mirror or an electric monitoring system of some kind which enables the operator on the ground to observe how well the cleaning is progressing without having to climb up to the level of the gutter. Some of the references describe the use of a mechanical device near the top of the conduit to break up debris before it travels the long distance down the conduit to reach a vacuum collection tank. However, the mechanical devices which are used to break up the debris are relatively complicated and add weight to the top portion of the conduit, making the apparatus heavier and more difficult to control, since this weight is at the end of a long pole or conduit which is high in the air.

The present invention overcomes many of the disadvantages of the devices described above, by providing an easy-to-operate, light weight design which can be used to clean the gutters or troughs of buildings which are 1 story or 2 stories in height. The weight of the portion of the apparatus which must be supported by the operator of the apparatus is typically about 6 pounds or less, depending on the attachment which is being used at the end of the apparatus which is in contact with the overhead open conduit. The controls which are needed to control function at the portion of the apparatus which is working adjacent the gutter or trough are present on the portion of the apparatus which is within easy reach of the hands of the operator.

SUMMARY

The apparatus can be used to remove debris from gutters, troughs, and other overhead open conduits. The apparatus includes a shaped conduit where the sidewalls are closed and each end of the conduit is open. The lower portion of the shaped conduit is straight, and the upper portion of the shaped conduit, which reaches from the lower portion into the overhead open conduit, exhibits a bend which allows the shaped conduit to reach over the edge of a gutter, for example, toward the bottom of the gutter. In one embodiment of the apparatus, the amount of bend which is present may be adjusted by hand prior to use. Attached to the exterior of the shaped conduit is a water line which can be used to provide a spray of water to the interior of overhead open conduit. The water loosens and softens leaves and debris and lubricates the inner walls of a flexible hose or other conduit which is used to carry the debris to a collection vessel which has a vacuum applied.

Along the straight section of the shaped conduit, or on a handle attached to the straight section of the shaped conduit, there is an on-off switch which sends a signal to a switch present on a wet-dry shop vacuum or other collection vessel attached to a source of vacuum which is used in conjunction with the apparatus. The vacuum source supplies a pulling force for removal of debris which is present in the overhead open conduit. Typically the on-off switch present on the apparatus is a wireless switch. Also along the straight section of the shaped conduit (or on a handle attached to the shaped conduit) there is a valve which controls the amount of water applied to the water line used to provide a spray of water.

Typically a handle is attached to the main body of the shaped conduit so that the positioning of the conduit relative to the overhead open conduit is easier and more precise. The on-off switch for the vacuum and the open-close valve for the water supply line are typically located next to the handle, if not on the handle, for ease of use. The opening in the lower, straight part of the shaped conduit is configured to fit into a coupling, or may include a coupling which enables the lower part of the shaped conduit to be attached to a flexible hose which leads to the shop vacuum or other source of vacuum. The flexible hose is sized to be large enough to handle accumulations of debris on its way to the vacuum source.

In one embodiment of the apparatus, which is advantageous when the overhead open conduit to be cleaned is higher off ground level, such as when the open conduit is two stories high, the shaped section of the conduit is shorter, and hose which is coupled to the shop vacuum or other source of vacuum travels the majority of the distance from the open conduit to the ground level. This reduces the amount of weight the user must carry. To permit control over the shaped conduit portion of the apparatus, a long handle is attached to the shaped conduit adjacent to the opening at the lower portion of the shaped conduit. Typically there is a collar around the bottom portion of the conduit and the handle is attached to the collar. There is an adjustable swivel joint at the top of the handle which is attached to the collar, and the swivel joint permits the user to manipulate the position of the shaped conduit relative to the overhead open conduit. The handle may be a telescoping handle, of the kind used in the painting industry, for example, to permit setting of the length of the handle to a convenient length. In the alternative, sections of handle may be fastened together using receptors at the ends of the sections, so that a desired length may be obtained. The water line to the water spray is coupled to a flexible, typically coiled hose which leads down to the handle, where a coupling is provided to the handle. The on-off valve for the water supply is located near the bottom of the handle, adjacent the on-off switch for the vacuum.

Optional features which may be present as part of the apparatus. One optional feature is a flexible, adjustable section near the top of the shaped conduit, which permits the user to adjust the angle of the bend from the straight section to the section which is placed into the open conduit such as the exemplary gutter. This flexible adjustable section may be a rubber hose with wire reenforced ribs to provide for adjustment in angle, for example. In the alternative, the flexible adjustable section may be a flexible hose of the kind which is used to connect to the shop vacuum and the adjustment in angle may be accomplished by a bendable wire or tubing which is present adjacent the flexible hose, for example. One of skill in the art of conduit formation will be able to find a number of designs of flexible, adjustable materials which may be used to form this bendable section of the section near the top of the shaped conduit.

There are a number of attachments which may be applied to the top opening in the shaped conduit which reaches into the overhead open conduit. These attachments may be of various shapes to enable the better cleaning of typical open conduits used for water transport. The portion of the attachment which contacts the surface of the open conduit are typically beveled in a manner which prevents a very tight seal between the attachment surface and the open conduit surface, which would make it difficult to move the apparatus along the open conduit during cleaning. In addition, a scraping device, which fastens to at least the leading edge of the attachment, may be removably attached to a basic attachment. Preferably the scraping device can be snapped or slid into place over the edge of the attachment.

The design of the apparatus makes it possible to periodically apply the vacuum to the apparatus as a means of breaking up blockages present within the apparatus which may prevent flow of the debris from the collection point at the open end of the shaped conduit present in the overhead open conduit to a collection vessel in which the debris is to be accumulated. As previously discussed, an on-off switch to the vacuum source and a valve to the water supply are placed at a location which enables the operator to reach them easily, with both typically being placed on or adjacent to the handle of the apparatus. Either of the on-off switch to the vacuum supply source, or the water supply valve, or a combination of both may then be periodically applied to cause a surge of the materials (water and debris) present in the debris movement path. This surge of vacuum, or surge of water, or a combination of surging vacuum and surging water (where the surges are simultaneous or offset) can be used to dislodge blockages in the debris movement path toward the debris collection vessel. Offset surges of vacuum and water may be overlapped. The frequency with which the vacuum application or the water application needs to be turned on or off will depend on the kind of debris which is present in the overhead open conduit, and can be easily determined by minimal experimentation of the operator of the apparatus.

DETAILED DESCRIPTION OF EXEMPLARY EMBODIMENTS

Figures 1, 1A:
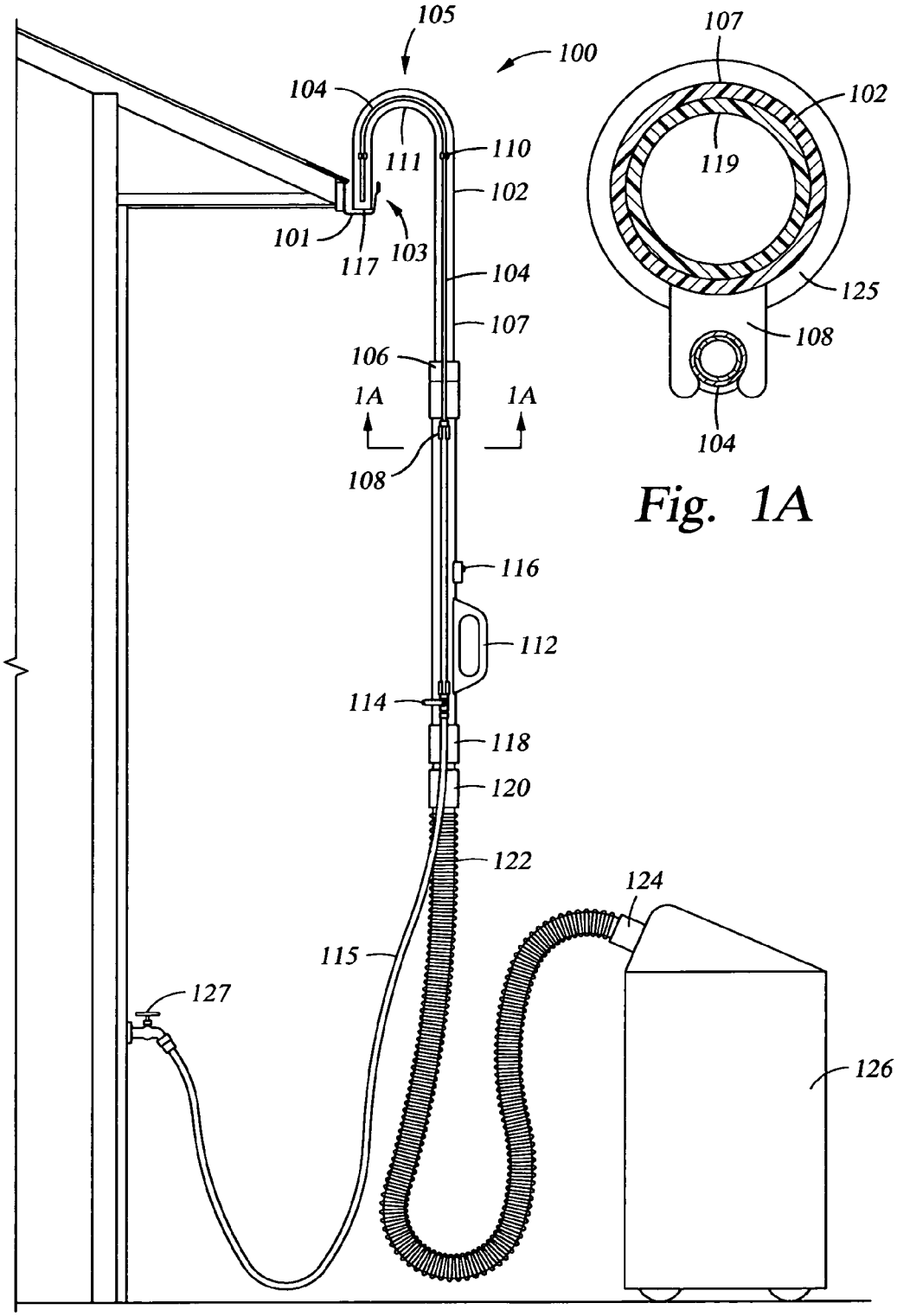
FIG. 1 shows a side view of an apparatus 100 which may be used to remove debris from gutters, troughs, and other overhead open conduits used for water flow, for example. The apparatus 100 includes a shaped conduit 102, including a bend 111 in the upper section 105 and a straight section 107. A water line 104, is detachably fastened using a fastener 108 (shown in detail in FIG. 1A) to the outside surface 110 of shaped conduit 102. A coupling 106, optionally a compression coupling, may be used to allow telescoping of the straight section 107 of the shaped conduit 102. Coupling 120 is used to attached the shaped conduit 102 to a flexible line 122, which is connected to a debris collection vessel 126 to which a vacuum source (not shown) is applied. Typically the collection vessel 126 is a wet-dry shop vacuum. The apparatus 100 also includes an on-off switch 116 which works in combination with a switch (not shown) attached to the collection vessel 126 or to a source of vacuum applied to collection vessel 126, to turn the vacuum on and off as desired. Typically the on-off switch 116 is wireless, and this works in combination with a wireless switch (not shown) which is placed on the power line leading to the collection vessel 126. The apparatus further includes a valve 114 for turning a water supply present in second water line 115 on and off when desired. The apparatus typically includes a handle 112 which is mounted on or directly attached to the shaped conduit 102, to permit ease of positioning of the shaped conduit 102.
FIG. 1A shows a cross section of the straight section 107 which includes an inside telescoped portion 119, the exterior shaped conduit 102, where a fastener 125 with extended area 108 is attached to the water line 104.

The apparatus can be used to remove debris from gutters, troughs, and other overhead open conduits used for water flow. With reference to FIG. 1, the apparatus 100 includes a shaped conduit 102 where the sidewalls are closed and each end of the conduit is open. The main body 107 of the conduit is straight, with an opening at the bottom (not shown), and an opening 117 from the upper portion 105 of the shaped conduit 102, which reaches from the main body 107 into the gutter, trough or other overhead open conduit 103, exhibits a bend 111 which allows the shaped conduit 102 to reach over the edge of overhead open conduit 103, so that the end 117 of the upper portion 105 of the conduit is adjacent the bottom 101 of the overhead open conduit 103, where the debris (not shown) to be removed is present. A second water line 115, typically extends from water line 104 to a water source such as water spigot 127. The flow of water through the shaped conduit 102, and flexible line 122 to collection vessel 126 lubricates the flow of the debris through the apparatus. A typical collection vessel 126 for the debris may be a wet-dry vacuum or other vacuum-assisted collection vessel 126. The water line 104 is best attached 108 to the outside surface 110 of the shaped conduit 102, so that its presence does not interfere with the progress of collected debris through the interior of shaped conduit 102 leading to the vacuum-assisted collection vessel 126. The attachment of water line 104 is typically a releasable attachment 125 of the kind shown in FIG. 1A, where a portion 108 of attachment 125 is capable of snapping onto water line 104. When the water applied to the overhead open conduit 102 is in the form of a spray, this helps dislodge debris from the overhead open conduit which is being cleaned.

One of the major problems which may be encountered during the cleaning operation is that debris which has a shape which is long, and possible forked, such as pine-needles and twigs, tends to form blockages inside of the shaped conduit 102. Some of the previously known devices for cleaning gutters, for example, made use of a cutting blade where the vacuum pulled debris against the blade (reducing the force of the vacuum along the vacuum line). Other known devices made use of a motorized cutting blade or paddle at the beginning of the cleaning device leading to the vacuum line (adding considerable weight at the extended end of the device) making it harder to direct the device along the open conduit to be cleaned. Applicant discovered that by turning the vacuum switch on and off he could frequently dislodge debris which had become jammed along the line leading to the collection vessel 126 (a wet-dry shop vac, for example and not by way of limitation). Applicant placed a switch 116 on or adjacent to handle 112, where the switch 116 could control the application of vacuum to collection vessel 126. Applicant was able to obtain a wireless switch which could be placed on the lower end of the shaped conduit 102 (on or adjacent to the handle typically on the apparatus), which worked in conjunction with a wireless switch (not shown) used in combination with the collection vessel 126, such as a wet-dry vac, so that the vacuum source could be turned on and off from a location at which the apparatus is held by the user. The switch to the vacuum source could be turned on and off with any frequency, to help dislodge debris which became jammed within the apparatus flow path toward collection vessel 126. In addition, the valve 114 to water line 104 could be turned on and off as desired. This ability to surge the application of vacuum or to surge the application of water, or a combination of both provided a surprising reduction in the number of times the apparatus had to be shut down so that a blockage could be manually removed from the apparatus.

Another feature which makes the apparatus easier to operate when a water spray is part of the apparatus is to have a valve 114 which permits adjustment of the water supply present on the lower end of the shaped conduit; either present on the handle 112 or adjacent the handle. This makes it possible to turn the vacuum on or off and to adjust the water flow to a sprayer with minimal motion of the hand or hands which are holding the apparatus. The opening in the lower part of the shaped conduit is configured to fit into a coupling 118/120 leading to a flexible conduit 122 which leads to the collection vessel 126. The shaped conduit 102 itself may have a lower straight section 107 which can be telescopic in nature, to enable toe shaped conduit 102 to reach a higher overhead open conduit 103. A telescopic coupling 106 is shown on FIG. 1. FIG. 1A shows a portion of the telescoping straight section 107 which includes an inner section 119 which may be extended.

Figure 11:
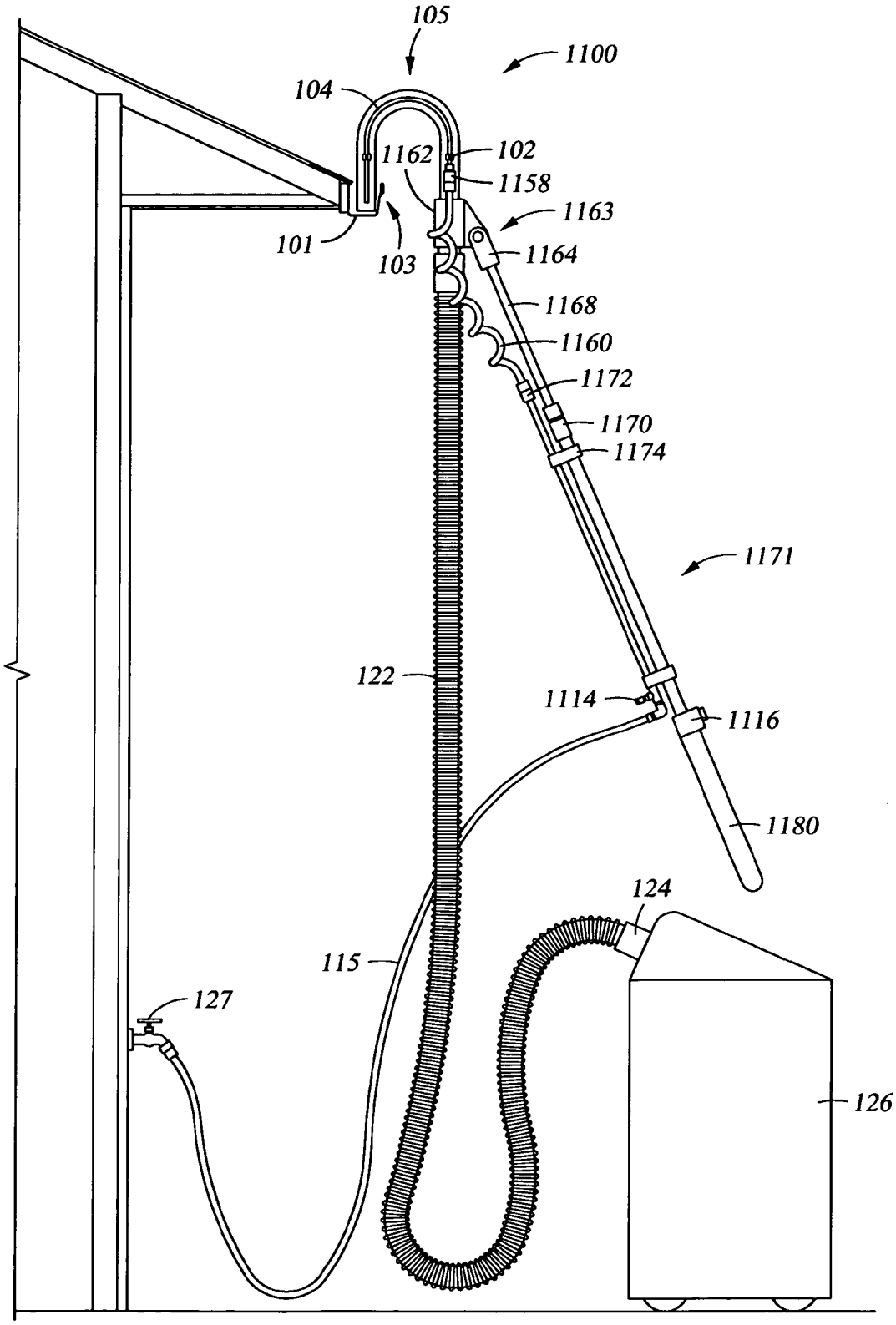
FIG. 11 shows a side view 1100 of an embodiment of the apparatus which is useful for cleaning open conduits which are higher above ground, for example on a second story of a building. The apparatus includes a shaped conduit 102, a water line 104, a coupling 1162 to attach the shaped conduit 102 to a vacuum line 122 which is connected to a collection vessel 126 to which a vacuum (not shown) is applied. The apparatus also includes an on-off switch 1116 which may be used to turn the vacuum on and off as desired. Typically the on-off switch 1116 is a wireless switch which works in combination with a switch (not shown) on the source of vacuum applied to collection vessel 126, to turn the vacuum on and off as desired. The apparatus further includes a valve 1114 for turning a water supply present in second water line 115 on and off when desired. The apparatus includes a long (typically extendable) handle 1180, which may include extendible sections 1168 to permit extension. The handle 1180 typically has the on-off switch 1116 for the vacuum mounted on or adjacent to handle 1180 and the valve 114 for water line 104 mounted on or adjacent to handle 1180, so that it is easy to reach the on-off switch 1116 and the valve 114 from the handle 1180.

In another embodiment, with reference to FIG. 11, which is advantageous when the overhead open conduit 102 to be cleaned is higher off ground level 1190, such as when the open conduit is two stories high, the shaped conduit 102 is shorter. The conduit/hose 122 which is coupled to the shop vacuum or other collection vessel 126 travels the majority of the distance from the overhead open conduit to the ground level. To permit control over the shaped conduit portion 105 of the apparatus 1100, a long handle 1171 is attached by a coupling to the shaped conduit 102 adjacent to the opening at the bottom portion of the conduit. Typically there is a collar 1162 around the bottom portion of the shaped conduit 102 and the handle 1171 is attached to the collar. The handle 1171 is typically attached to collar 1162 by an adjustable swivel joint 1163/1164 which is present at the top of the handle. The swivel joint permits the user to manipulate the position of the shaped conduit 102 relative to the overhead open conduit 103. The handle 1171 may include telescoping sections 1168 coupled using couplers 1170, to permit setting of the length of the handle 1171 to a convenient length. In the alternative, sections of handle may be fastened together. The water line 104 is coupled 1158 to a flexible, typically coiled hose 1160 which leads down to the handle 1171, where a coupling 1174 is provided to the handle. The on-off valve 1114 for the water supply is located near the bottom of the handle 1171, adjacent the on-off switch 1116 for the applied vacuum (not shown).

In more detail, FIG. 1 shows a side view of an apparatus 100 which may be used to remove debris from gutters, troughs, and other overhead open conduits 103 used for water flow, for example. The apparatus includes a shaped conduit 102, which has an opening at each end, and a water line 104. The shaped conduit 102 includes a shaped portion 105 which is bent 111 to permit the shaped portion 105 of shaped conduit 102, with opening 107, to be placed near the bottom 101 within the overhead open conduit 103. The lower portion of the shaped conduit 102 is attached by a coupling 118, 120 to a transfer line 122 which is connected to a port 124 on a collection vessel 126. The collection vessel 126 is typically a wet-dry shop vac; however, any containment vessel with an applied vacuum system may be used. The apparatus also includes an on-off (preferably wireless) switch 116 which works in combination with a switch (not shown) at the collection vessel 126 to turn the vacuum on and off as desired. Typically the shaped conduit 102 includes a handle 112 which may be formed on or attached to shaped conduit 102. Handle 112 is useful during positioning of the apparatus 100 with respect to open conduit 103. The water line 104 present along a surface of shaped conduit 102 is typically held in place by fasteners 110, and ends at a valve 114 which is used to control the amount of water fed to water line 104 and to turn off the water. The valve 114 is in communication with a second water line (hose) 115, which may be attached to an outside water spigot 127 from a home or other building. The handle 112 which is mounted on or directly attached to the shaped conduit 102, to permit ease of positioning of the shaped conduit 102.

Figure 2A:
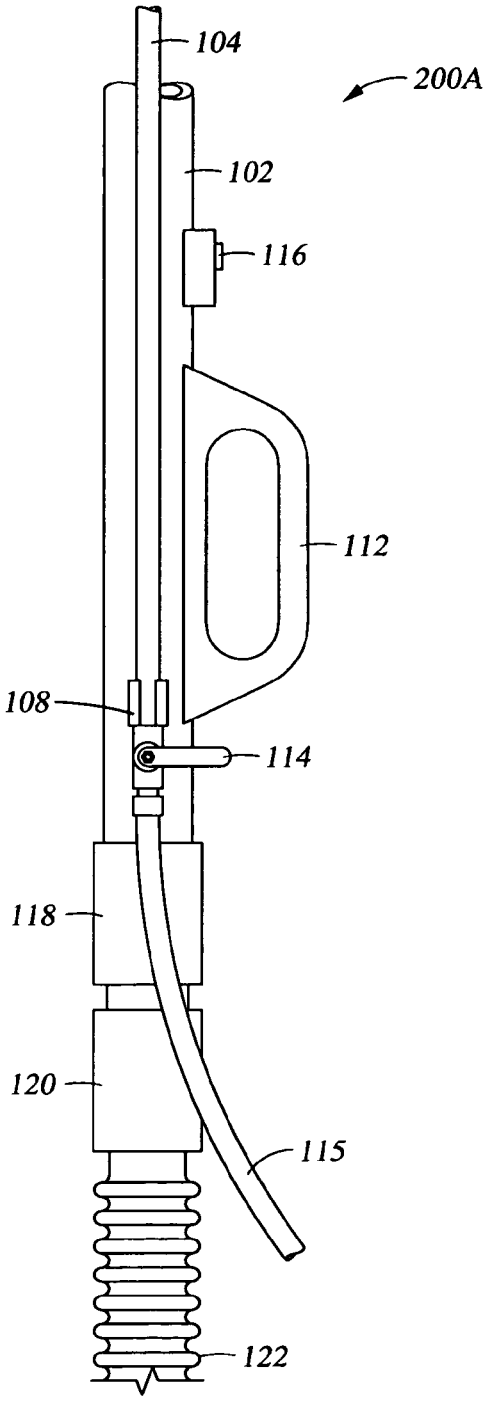
FIG. 2A shows a close up side view 200A of the area of the shaped conduit which contains the on-off switch 116 for the vacuum source (not shown) and the control valve 114 for the water line 104.
Figure 2B:
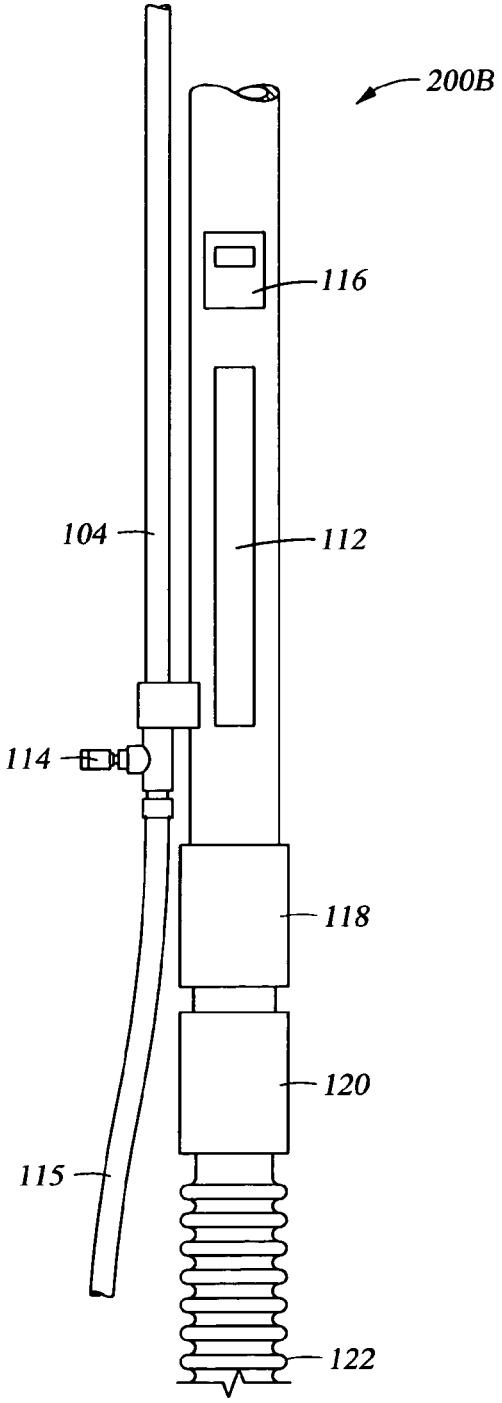
FIG. 2B shows a close up top view 200B of the area of the shaped conduit which is shown in FIG. 2A.

FIG. 2A shows a close up side view 200A of the area of the shaped conduit 102 which contains the on-off switch 116 for the vacuum source (not shown) and the control valve 114 for the water line 104. Typically present in this same area is handle 112. This enables the operator to control the necessary functions and the positioning of the apparatus within a relatively small area of the apparatus. FIG. 2B shows a close up top view 200B of the area of the shaped conduit which is shown in FIG. 2A.

Figure 3:
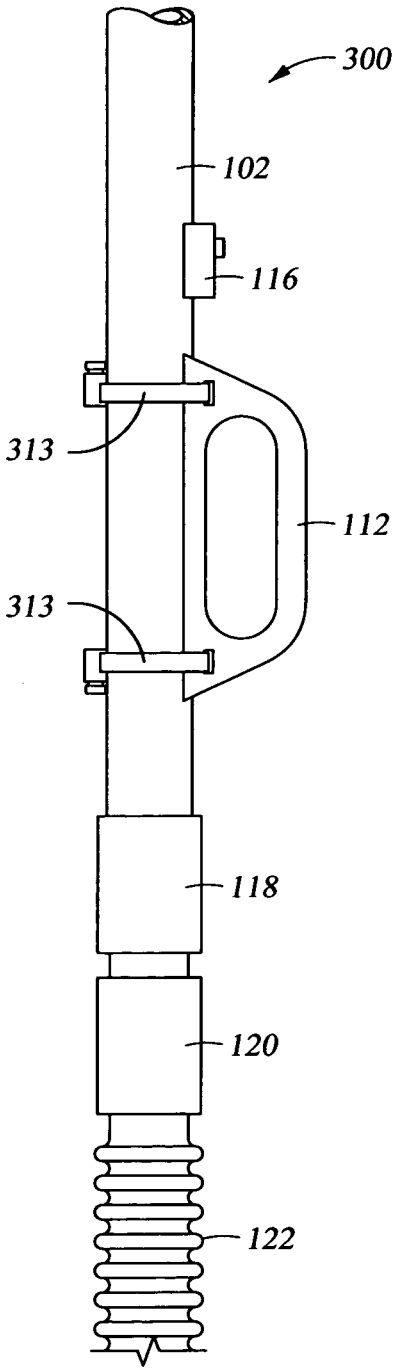
FIG. 3 shows a close up side view 300 of a handle 112 which is attached to the exterior of the lower portion of the shaped conduit 102 using a coupling device 313.
Figure 4:
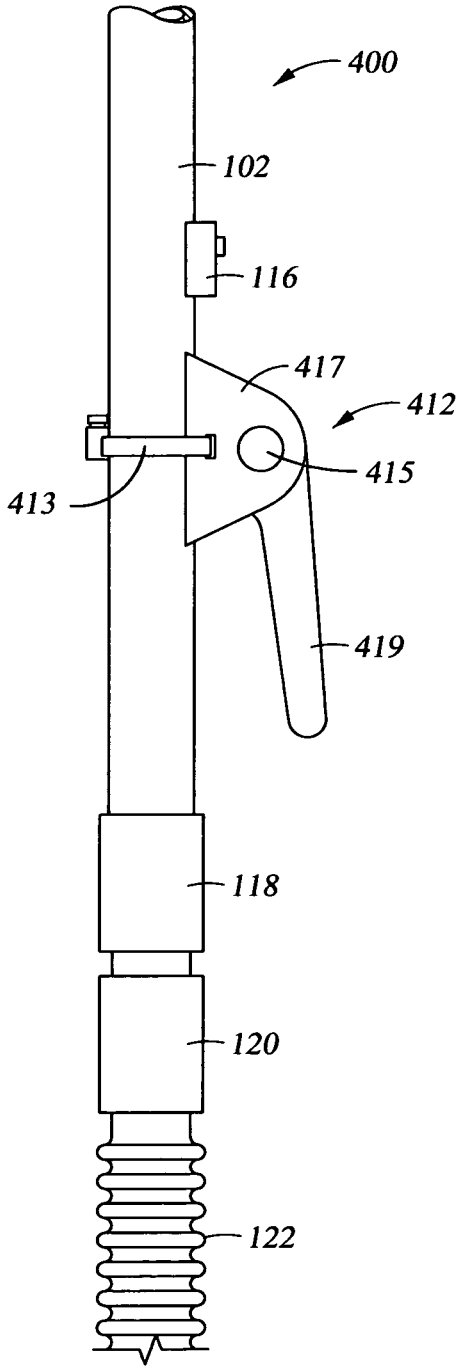
FIG. 4 shows a close up side view 400 of an alternative handle 412 which is attached to the exterior of the lower portion of the shaped conduit 102 using a coupling device 413. Handle 412 includes a lever arm 419, and a spindle 415 which permits lever arm 419 to be rotated around on base 417 as desired. This may be referred to as an adjustable swivel joint.

FIG. 3 shows a close up side view 300 of a handle 112 which is attached to the exterior of the lower portion of the shaped conduit 102 using a coupling device 313. The coupling device is one of the kind known in the art which can be easily adjusted to move the handle 112 along the length of shaped conduit 102 which is more convenient to the user. FIG. 4 shows another kind of handle 412 which includes a lever 419 which can rotate around a spindle 415 present in base 417. Handle 415 is attached with coupling 413 which is one of the kind known in the art which can be easily adjusted to move handle 412 along the length of shaped conduit 102.

Figure 5A:
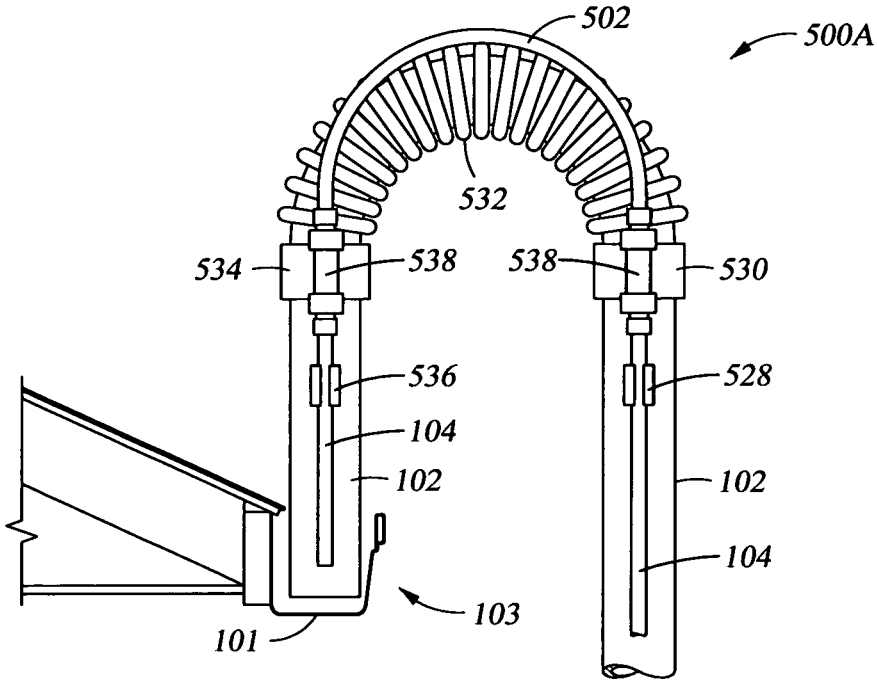
FIG. 5A shows an embodiment of the invention in which the shaped portion 500A at the top of the shaped conduit 102 is a flexible structure 532, such as a rubbery exterior with a wire-containing interior, to permit bending and maintenance of the bent position until readjusted. The tubing or hose 502 which makes up a portion of the water flow line 104 is also formed of a flexible material, which may be a plastic tubing, for example.
Figure 5B:
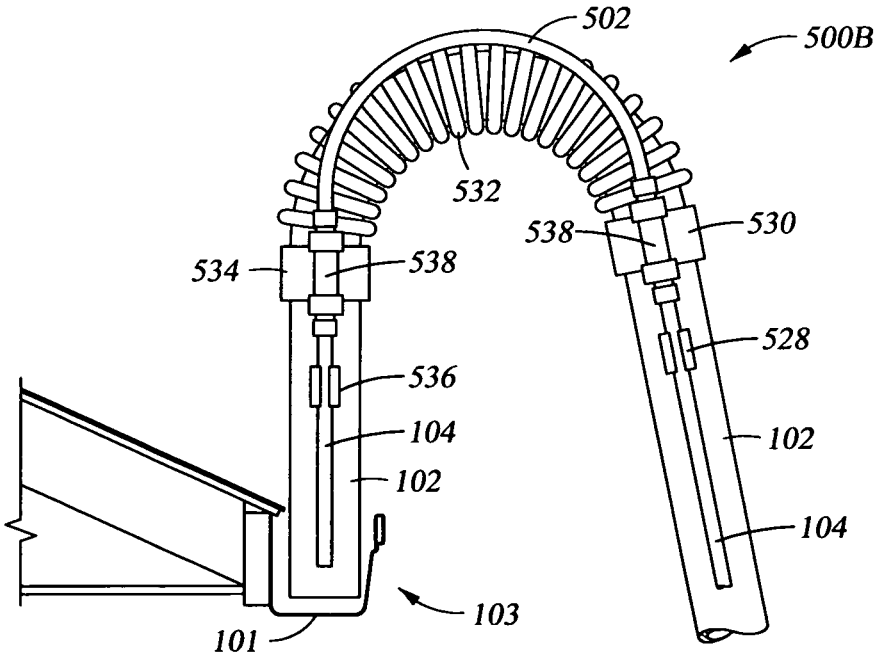
FIG. 5B shows the shaped portion 500B at the top of the shaped conduit 102 when the shaped portion is bent into a different configuration than that shown in FIG. 5A.

FIG. 5A shown an embodiment of the invention in which the shaped portion 500A at the top of the shaped conduit 102 is a flexible structure 532, such as a rubbery exterior with a wire-containing interior (or other similar flexible structures known in the art), to permit bending and maintenance of the bent position until it is desired to change the shape of flexible structure 532. The tubing or hose 504 which makes up a portion of the water flow line 104 is also formed of a flexible material in the area of flexible structure 532. The tubing or hose 504 flexible material may be a flexible plastic or rubber tubing, for example. The flexible structure is attached to shaped conduit 102 using couplers 530 and 534. When the water line 104 is a more rigid material, such as a rigid plastic or a metal, the tubing or hose 504 is attached to the more rigid water line 104 material using couplers 538, and is fastened to shaped conduit 102 using fasteners 536 and 528. FIG. 5B shows the shaped portion 500B when the bend in the flexible structure 532, which forms the upper portion of shaped conduit 102 is at a different angle with respect to the section of shaped conduit 102 which is present in the open conduit 103.

Figure 6A:
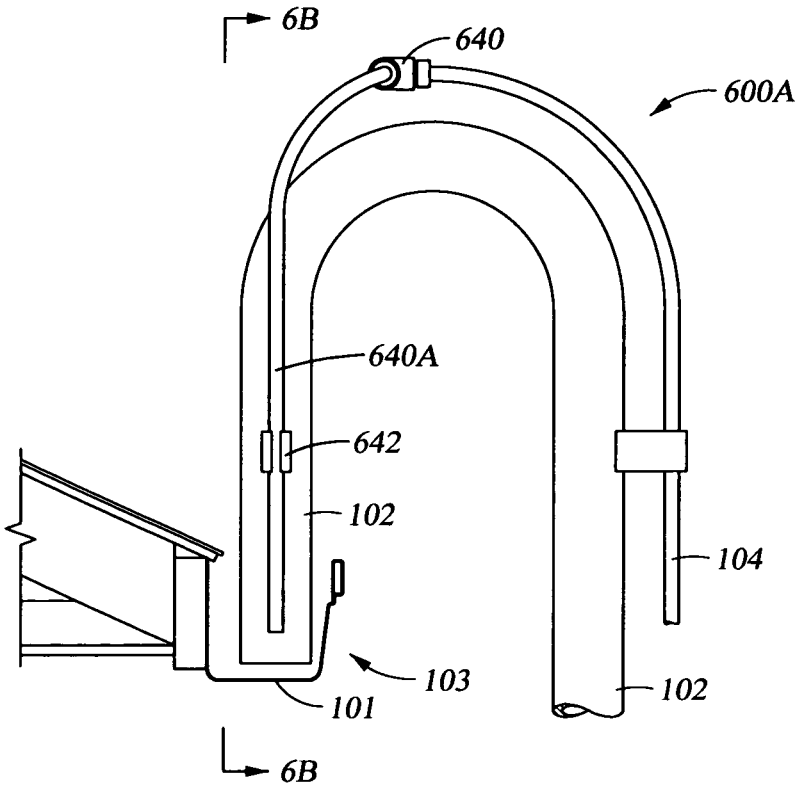
FIG. 6A shows a side view 600A of an embodiment of the invention which makes use of dual water spray on each side of the shaped conduit 102. One of the water lines 604A which flow from the main water line 104 is shown in this view.
Figure 6B:
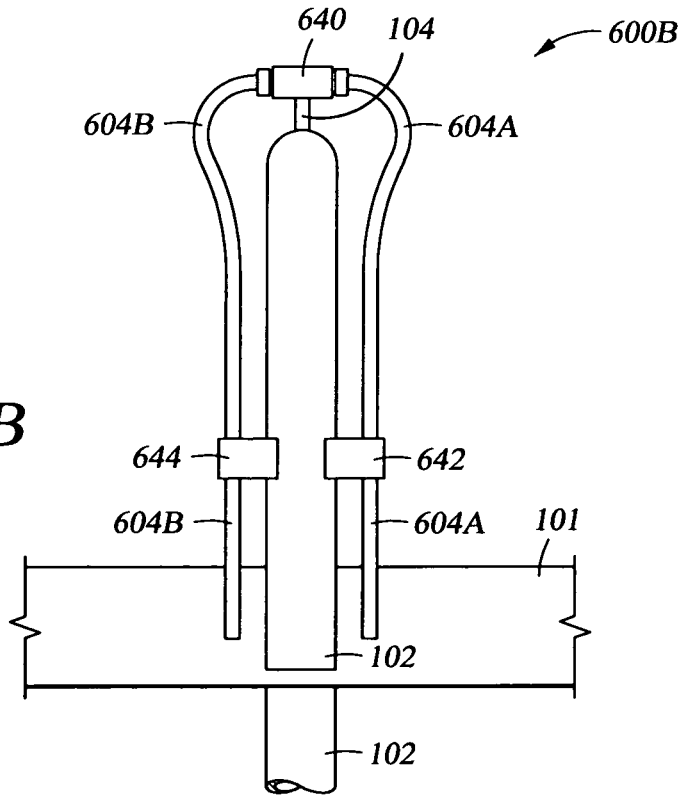
FIG. 6B shows a front view 600B of the embodiment of the invention shown in FIG. 6A, and shows the two water lines 604A and 604B which come from a "T" shaped fitting 640 which connects lines 604A and 604B of the main water line 104.

FIG. 6A shows a side view 600A of an embodiment of the invention which makes use of dual water spray on each side of the shaped conduit 102. One of the water lines 604A which flow from the main water line 104 is shown in this view. where a "T" shaped connection 640 joins water line 604 A and water line 604B (not shown) to the main water line 104. FIG. 6B shows a front view 600B of the embodiment of the invention shown in FIG. 6A, and shows the two water lines 604A and 604B which come from a "T" shaped connection 640 which connects lines 604A and 604B to the main water line 104. Water line 604 A is attached to shaped conduit 102 by fastener 642, and water line 604B is attached to shaped conduit 102 by fastener 644.

Figure 7:
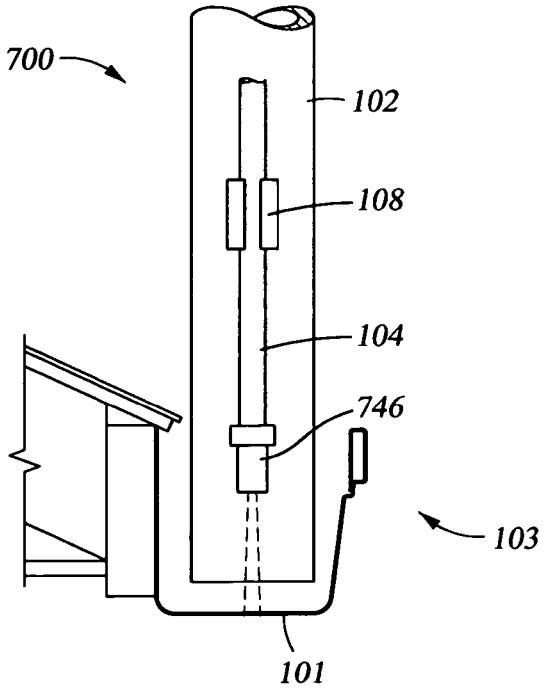
FIG. 7 shows a side view 700 of the water line 104 attached to the section of shaped conduit 102 which is placed in an exemplary gutter 103, where the spray nozzle 746 from which water is applied provides a narrow spray.
Figure 8:
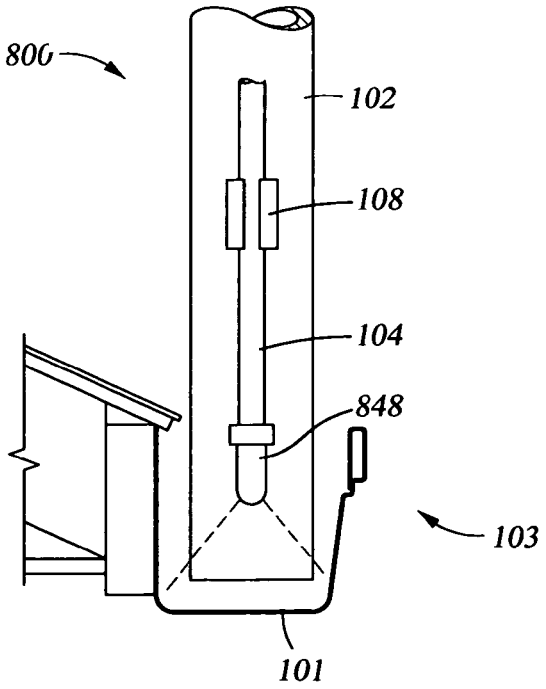
FIG. 8 shows a side view 800 of the water line 104 where the spray nozzle 848 is one which applies a broad spray.

FIG. 7 shows a side view 700 of the water line 104 attached to the section of shaped conduit 102 which is placed in an exemplary gutter 103, where the spray nozzle 746 from which water is applied provides a narrow spray. FIG. 8 shows a side view 800 of the water line 104 where the spray nozzle 848 is one which applies a broad spray.

Figure 9:
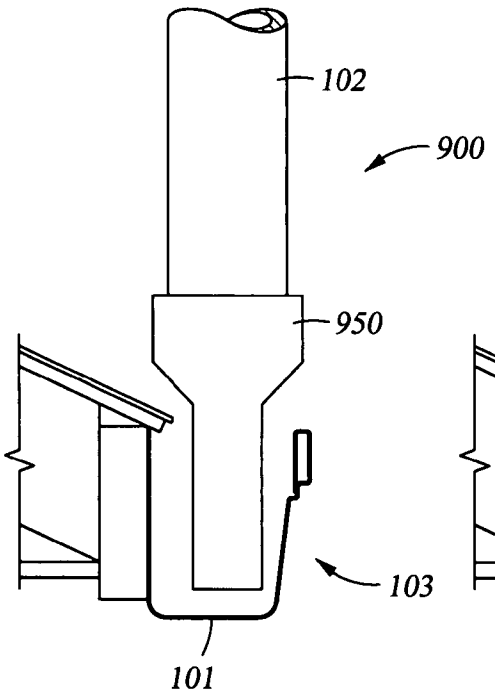
FIG. 9 shows a side view 900 of an attachment 950 which may be placed on the end of the shaped conduit 102 to distribute the vacuum over a narrow width of space in exemplary gutter 103.

FIG. 9 shows a side view 900 of an attachment 950 which may be placed on the end of the shaped conduit 102 to distribute the vacuum over a narrow width of space in exemplary gutter 103. FIG. 10A shows a side view 1000 of another attachment 1052 which may be placed on the end of the shaped conduit 102 to distribute the vacuum over a wider width of space in exemplary gutter 103.

FIG. 10A shows a side view 1000 of another attachment 1052 which may be placed on the end of the shaped conduit 102 to distribute the vacuum over a wider space in overhead open conduit 103.

Figure 10B:
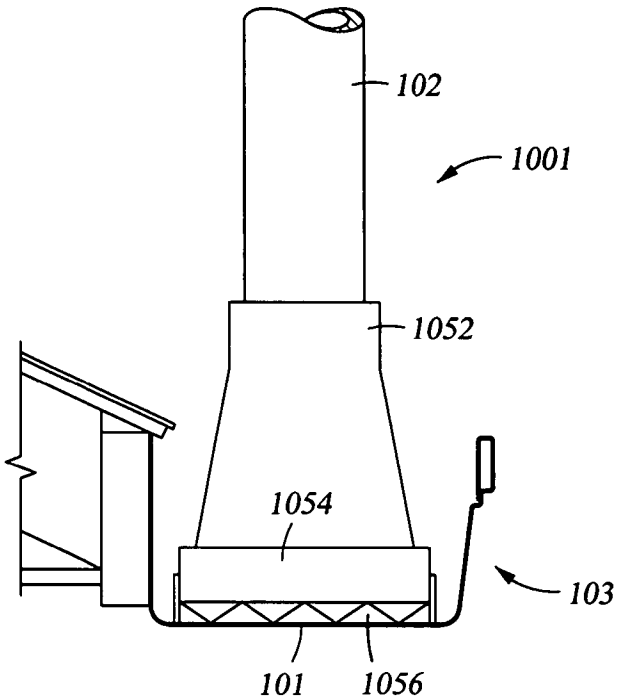
FIG. 10B shows the attachment 1052 of FIG. 10A, where a scraping device 1056 has been applied to a leading edge of the attachment 1052 to assist in dislodging debris to make it easier for the applied vacuum to pick up the debris.
Figure 10A:
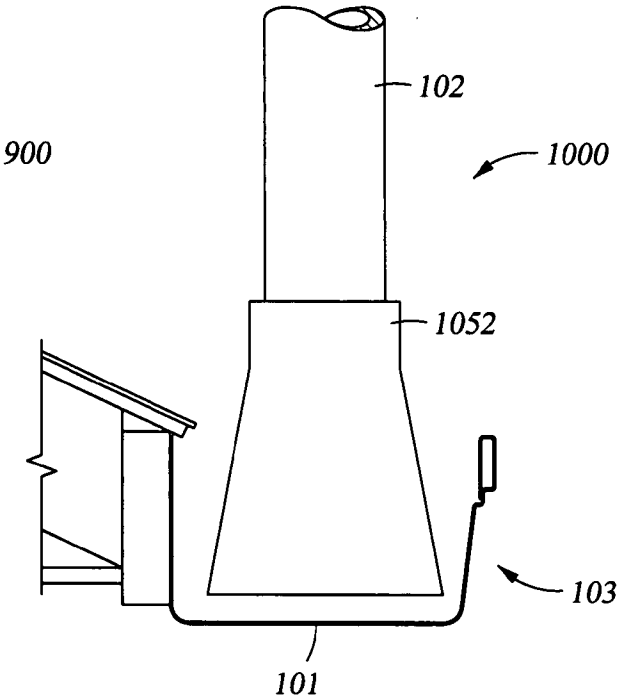
FIG. 10A shows a side view 1000 of another attachment 1052 which may be placed on the end of the shaped conduit 102 to distribute the vacuum over a wider width of space in exemplary gutter 103.

FIG. 10B shows the attachment 1052 of FIG. 10A, where a scraping device 1056 has been applied to the front of a leading edge of the attachment 1052 to assist in dislodging debris to make it easier for the applied vacuum to pick up the debris, as the vacuum passes over a surface which has been scraped by the leading edge of the attachment.

FIG. 11 shows a side view 1100 of an embodiment of the apparatus which is useful for cleaning open conduits which are higher above ground 1190, for example on a second story of a building. The apparatus includes a shaped conduit 102, where the upper open end of the shaped conduit is inserted into the open conduit 103 which needs to be cleaned. The upper portion of shaped conduit 102 is bent in a manner which permits the insertion upper portion of shaped conduit 102 into open conduit 103 while the bottom portion of shaped conduit 102 is relatively perpendicular to the ground beneath 1190. The lower portion of shaped conduit 102 is coupled using couplers 160 and 162 to a vacuum line 122 which is connected by a coupling 124 to a collection vessel 126. To permit control over the shaped conduit 102 portion of the apparatus 1100, a long handle 1171 is attached to the shaped conduit 102 adjacent to the opening at the bottom portion of the shaped conduit 102. Typically there is a collar/connector 1162 around the bottom portion of the shaped conduit 102, and the handle 1171 is attached to the collar 1162. The attachment means is conveniently an adjustable swivel joint 1163/1164, at the top of the handle, with adjustable swivel joint 1163/1164 attached to the collar 1162. The swivel joint permits the user to manipulate the position of the shaped conduit 102 relative to the overhead open conduit 103. The handle 1171 may include telescoping sections 1168 coupled using couplers 1170, to permit setting of the length of the handle 1171 to a convenient length. In the alternative, individual sections of handle (not shown) may be provided to be fastened together as desired.

The apparatus includes a water line 104 attached to the upper shaped portion of shaped conduit 102, a water line coupling 1158 may be used to attach the water line 104 to an upper part of a section of coiled water line 1160, with a coupling 172 used to attach the coiled water line 1160 to a more rigid water line 104 which is present on handle 1171. The water line 104 section present on handle 1171 is attached to a valve 1114 which is coupled 1178 to a second water line (hose) 115 which is attached to a water spigot 127. The apparatus also includes an on-off wireless switch 1116 which works in combination with a switch (not shown) on the containment vessel 26, which turns the vacuum on and off as desired. The on-off wireless switch 1116 is present on or adjacent to a base section 1180 of handle 1171. The apparatus further includes a valve 1114 for turning a water supply present in second water line 115 on and off when desired. The valve 1114 for second water line 115 is mounted adjacent to the base section 1180 of handle 1171, so that it is easy to reach the on-off switch 1116 and the valve 1114 from the handle 1180.

The design of the apparatus makes it possible to periodically apply the vacuum to the apparatus as a means of breaking up blockages present within the apparatus which may prevent flow of the debris from the collection point at the open end of the shaped conduit which is placed in the overhead open conduit to a collection vessel in which the debris is to be accumulated. As previously discussed, an on-off switch to the vacuum source and a valve to the water supply are placed at a location which enables the operator to reach them easily, with both typically being placed on the handle of the apparatus. Either of the on-off switch, or the water supply valve, or a combination of both may then be periodically applied to cause a surge of the materials (water and debris) present in the debris movement path. This surge of vacuum, or a surge of water, or a combination of surging vacuum and surging water (where the surges are simultaneous or offset) can be used to dislodge blockages in the debris movement path toward the debris collection vessel. Offset surges of vacuum and water may be overlapped. The frequency with which the vacuum application or the water application needs to be turned on or off will depend on the kind of debris which is present in the overhead open conduit, and can be easily determined by minimal experimentation of the operator of the apparatus.

While the foregoing is directed to embodiments of the present invention, other and further embodiments of the invention may be devised in view of the present disclosure, without departing from the basic scope of the invention, and the scope thereof is determined by the claims which follow.

I claim:

1. An apparatus used to remove debris from gutters, troughs, and other overhead open conduits, comprising:

a shaped conduit having closed sidewalls and an opening at each end, wherein an upper portion of said shaped conduit includes a hand-bendable section and a lower portion of said shaped conduit is straight, wherein a desired configuration of said hand-bendable section may be adjusted, by direct application of hand pressure upon a surface of said hand-bendable section, and wherein said desired configuration is maintained until readjusted by direct application of hand pressure upon a surface of said hand-bendable section;

a water supply line which is releasably attached to an exterior surface of said shaped conduit and which supply line adjusts to conform with said hand-bendable section of said shaped conduit when said hand-bendable section is adjusted in shape;

a valve which works in conjunction with said water supply line to control an amount of water which is applied;

a wireless on-off switch which sends a signal to a switch on a vacuum source which works in conjunction with said apparatus, so that a vacuum may be applied, discontinued, and re-applied to said shaped conduit at a desired frequency; and a flexible hose which extends from the straight portion of said shaped conduit to facilitate attachment to a source of vacuum.

2. An apparatus in accordance with claim 1, wherein a handle is attached to said lower, straight portion of said shaped conduit.

3. An apparatus in accordance with claim 2, wherein said handle includes an adjustable lever portion which is adjustable relative to said lower, straight portion of said shaped conduit.

4. An apparatus in accordance with claim 1, wherein said valve which controls an amount of water applied and said wireless on-off switch to control application of vacuum are both positioned on or adjacent to a handle which is used to control a position of said apparatus relative to an overhead open conduit.

5. An apparatus in accordance with claim 1, wherein a portion of said shaped conduit which forms said hand-bendable section can be removed and replaced if needed.

6. An apparatus in accordance with claim 1, further including at least one attachment for use in combination with said open end of said shaped conduit which is placed within the overhead open conduit.

7. An apparatus in accordance with claim 6, further including a scraper which is present on a leading edge of said attachment, so that debris is loosened as said attachment progresses along a surface of said open conduit.

8. An apparatus in accordance with claim 7, wherein said scraper is removably mounted on said leading edge of the attachment.

9. An apparatus in accordance with claim 1, wherein a source of water feeds a divider which distributes said water supply line into at least two secondary water lines which are arranged on an exterior surface of said upper portion of said shaped conduit, so that water is supplied at more than one location within said overhead open conduit.

10. An apparatus in accordance with claim 1, wherein said water supply line feeds a restriction device which acts as a pressure increasing nozzle to increase a force generated from a spray exiting into said overhead open conduit.

* * * * *